US007817959B2

(12) United States Patent
Harrison

(10) Patent No.: US 7,817,959 B2
(45) Date of Patent: Oct. 19, 2010

(54) METHOD AND SYSTEM FOR SELECTIVELY STORING INFORMATION RECEIVED FROM A BROADCAST SIGNAL

(75) Inventor: Martin Paul Harrison, Reading (GB)

(73) Assignee: Imagination Technologies Limited, Kings Langley, Hertfordshire (GB)

( * ) Notice: Subject to any disclaimer, the term of this patent is extended or adjusted under 35 U.S.C. 154(b) by 797 days.

(21) Appl. No.: 11/704,006

(22) Filed: Feb. 8, 2007

(65) Prior Publication Data

US 2007/0206627 A1 Sep. 6, 2007

(51) Int. Cl.
*H04H 40/00* (2008.01)

(52) U.S. Cl. ..... 455/3.06; 455/3.05; 455/3.04

(58) Field of Classification Search ..... 455/3.02, 455/3.03, 3.05, 3.06, 412.1, 414.1; 725/29, 725/46, 47, 48, 49, 58, 100, 139, 151, 131; 709/203, 217, 220

See application file for complete search history.

(56) References Cited

U.S. PATENT DOCUMENTS

| | | | | |
|---|---|---|---|---|
| 6,148,330 | A * | 11/2000 | Puri et al. | 709/217 |
| 6,975,835 | B1 * | 12/2005 | Lake et al. | 455/3.01 |
| 7,274,906 | B1 * | 9/2007 | Nguyen et al. | 455/3.05 |
| 2003/0037333 | A1 * | 2/2003 | Ghashghai et al. | 725/46 |
| 2006/0229056 | A1 | 10/2006 | Zink et al. | |
| 2008/0271075 | A1 * | 10/2008 | Kawai | 725/39 |

FOREIGN PATENT DOCUMENTS

| | | | |
|---|---|---|---|
| EP | 1 035 674 | A2 | 9/2000 |
| GB | 2 275 849 | A | 9/1994 |
| GB | 2 357 667 | A | 6/2001 |
| GB | 2 406 452 | A | 3/2005 |
| WO | WO 2004/102844 | A2 | 11/2004 |
| WO | WO 2005/022790 | A1 | 3/2005 |

OTHER PUBLICATIONS

United Kingdom Search Report dated May 16, 2006 (4 sheets).
International Search Report and Written Opinion dated May 22, 2007.

* cited by examiner

*Primary Examiner*—Jean A Gelin
(74) *Attorney, Agent, or Firm*—Flynn, Thiel, Boutell & Tanis, P.C.

(57) ABSTRACT

A method for selectively storing information received from a broadcast signal is provided. The method includes the steps of: receiving and identifying a broadcast message, the message including a plurality of characters; comparing each character of the received message with a start of tag (SOT) identifier stored in a memory; if a character received in the received message is determined to match the SOT identifier stored in the memory then comparing each of the subsequent characters in the received message with an end of tag (EOT) identifier stored in the memory determining if the received message contains both SOT and EOT identifiers; and storing the message in a storage unit in dependence on the result of the determination.

13 Claims, 2 Drawing Sheets

METHOD AND SYSTEM FOR SELECTIVELY STORING INFORMATION RECEIVED FROM A BROADCAST SIGNAL

FIELD OF THE INVENTION

This invention relates to broadcast receivers, preferably digital receivers which can receive and preferably display information, preferably textual information transmitted with a broadcast signal or program to provide additional information to a user.

BACKGROUND OF THE INVENTION

The invention will be described referring to digital receivers, for example digital receivers using the Digital Audio Broadcast (DAB) standard, however, those skilled in the art will appreciate that an embodiment of the invention could advantageously be used for example with analogue receivers equipped with the Radio Data System (RDS), or with television or other receivers.

Both digital radio receivers, and analogue radio receivers equipped with RDS are capable of receiving signals which are decoded as text to be shown on a user display as well as the usual audio signals.

With current digital radio receivers a broadcaster determines what text encoded with the broadcast radio signal is intended for display on a receiver. The receiver however determines the duration for which the message is displayed on the receiver. Typically the message is scrolled on a display and discarded. Therefore information which may be of interest to a user is generally only transiently available to the user at the time of transmission.

SUMMARY OF THE INVENTION

In accordance with a first aspect of the present invention there is provided both a method and a system for selectively storing information received from a broadcast signal comprising the steps of receiving and identifying a broadcast message, the message comprising a plurality of characters; comparing each character of the received message with a start of tag (SOT) identifier stored in a memory; if one or more character(s) received in the received message is determined to match the SOT identifier stored in the memory then comparing each of the subsequent characters in the received message with an end of tag (EOT) identifier stored in the memory; determining whether the received message contains both SOT and EOT identifiers; and storing the message in a storage unit in dependence on the result of the determination.

Preferably, the received information is also displayed on a display.

Preferably, if it is determined that the stored message contains one or more characters matching one or more formatting characters stored in a memory unit, the information received in the message is displayed in a format in dependence upon the matching formatting characters.

BRIEF DESCRIPTION OF THE DRAWINGS

The invention will now be described in detail by way of example with reference to the accompanying drawings, in which.

DETAILED DESCRIPTION OF THE PREFERRED EMBODIMENTS OF THE INVENTION

Figure 1:
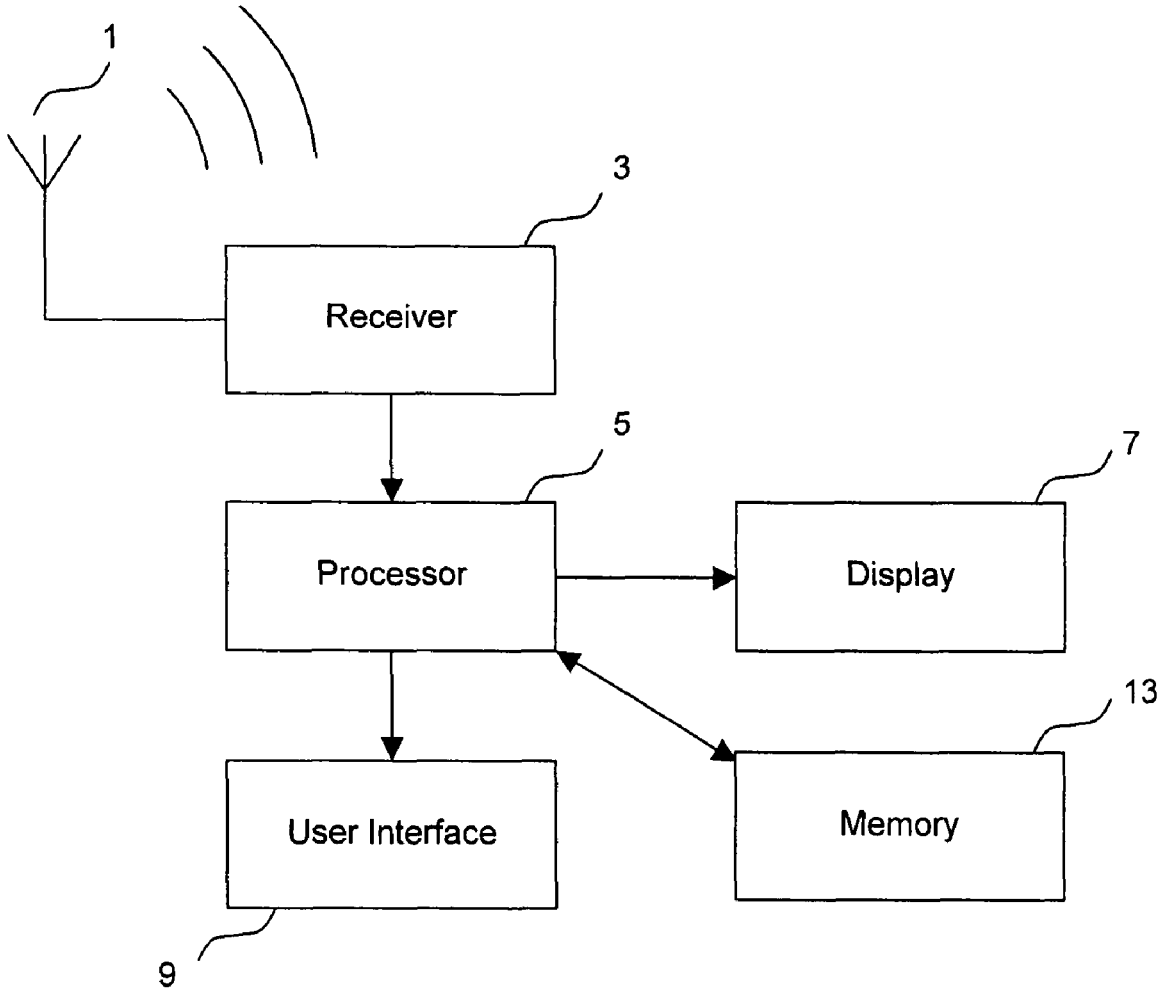
FIG. 1 is a block diagram showing the main functional components of a digital radio receiver unit, preferably a Digital Audio Broadcast (DAB) receiver embodying the invention.

In one embodiment of the present invention illustrated in FIG. 1, a digital radio receiver comprises an antenna 1, a receiver unit 3 to receive broadcast signals, a processor (comparator) 5, and a memory unit 13, preferably a non-volatile memory unit. Preferably this embodiment also includes a display 7 to view received text, and a user interface 9. These functional components are described in further detail below.

Figure 2:
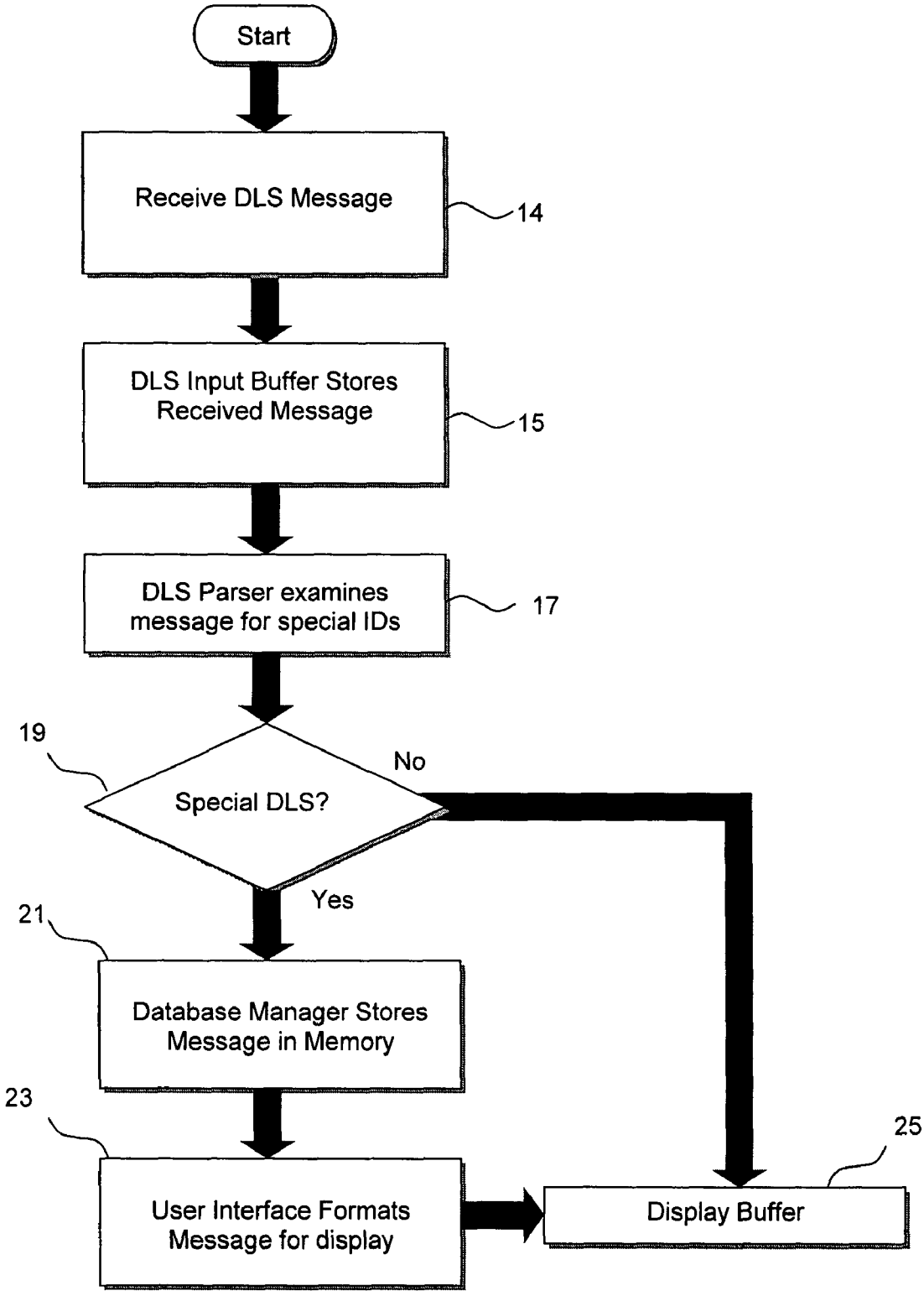
FIG. 2 is a flow chart showing the main steps performed by an embodiment of the invention.

Referring to FIG. 1 and to the flow chart in FIG. 2 of the drawings, messages received and displayed on digital radios are transmitted by a broadcaster as dynamic label segment (DLS) messages. DLS messages are typically seen on the radio receiver equipment as scrolling text on the display. So-called Normal DLS messages are the messages currently transmitted by all broadcasters to digital radios. However, once these messages have been displayed they are discarded by the digital radios. We have appreciated, however that tagged DLS messages can advantageously be provided. These tagged DLS messages are formatted using identifier characters which are preferably normal American Standard Code for Information Interchange (ASCII) characters, for example one or more of the following characters shown inside quotation marks: "*", ":", "-". Other characters, both ASCII and non-ASCII can also be used.

All digital receivers are capable of receiving such characters, however, only receivers embodying the invention employ a specific parsing algorithm to perform specific actions as a result of receiving these characters.

FIG. 2 shows a flow chart illustrating the steps performed by an embodiment of the invention. First, text transmitted preferably as DLS messages by the broadcaster along with the audio signals is received by the receiver 3 at step 14.

The DLS message is then held in a DLS input buffer (not shown on FIG. 1) at step 15. The input buffer can be part of the receiver unit 3, or alternatively can be separately provided. A DLS parser then processes the data on the processor 5 and examines the message for special predefined identifiers that delimit a DLS tagged message at step 17.

If a valid "start of tag" (SOT) identifier is found by the processor (comparator) the algorithm searches for an "end of tag" (EOT) identifier. If the EOT identifier is also found, this means that the message is determined to be a DLS tagged message, step 19. The text between the SOT and EOT identifiers is the DLS tag, and examples of DLS tags are "RESULTS", or "NEWS" etc. The DLS tag can also contain formatting characters such as "-" which is used by the processor to format the message when subsequently displaying the DLS message.

Five examples of tagged DLS messages or strings are shown below:

"*Menu Root—Sub Menu[3]—Sub Menu[1]: First Menu Item"

"*Menu Root[2]: Third Menu Item; Fourth Menu Item"

"*Menu Root—Sub Menu[2]: Third Menu Item"

"*Menu Root—Sub Menu[1]: First Menu Item; Second Menu Item"

"*Menu Root[1]: First Menu Item; Second Menu Item"

The asterisk '*' is the SOT identifier and the colon ':' is the EOT identifier. The semi-colon ';' is used as a delimiter between menu items. Additional text formatters (in this example a dash '-' is used) can be used to provide additional levels of hierarchy or data indexing. Of course other characters can equally be used as SOT, EOT identifiers or text formatting characters. Note that in the above example, each tagged DLS message is transmitted separately, so that there are five tagged DLS messages in total.

Preferably, messages are categorised according to their DLS tag before being stored in the memory 13. To do this, the processor 5 examines the DLS tag. In the above example, one of the DLS messages has a DLS tag "Menu Root—Sub Menu [3]—Sub Menu[1]".

The processor 5 first determines whether or not there are any formatting characters such as "-" contained within the DLS tag. It does this by comparing each character of the DLS tag to each formatting character stored in the memory (13). The processor interprets each formatting character so that when text is displayed on the display (see later) it is displayed in a format dependent upon the matching formatting character. Furthermore, formatting characters can also be used to categorise the information so that a user can easily retrieve information at a later time. In this example, the processor would locate two "-" characters. These are therefore interpreted by the processor to mean that the text to the right of the formatting character is to be categorised under a sub-menu prior to storage. When displaying text, text within a menu or category can be indented from the menu itself so that items within a menu can easily be identified. The category or title of a particular menu is determined by the processor as the text following a formatting character such as "-" but before any text in square brackets such as [3], known as an order parameter (see later). Alternatively if there is no order parameter, then the menu category is determined as the text following a formatting character which immediately proceeds an EOT identifier such as ":" or any other formatting character.

In this example, the processor will determine that it should categorise the text after the EOT identifier as the first row of text inside a Sub Menu, the Sub Menu being located as the third item inside a further Sub Menu. This is diagrammatically illustrated later.

When the messages are displayed on the display (see later), the messages are presented to the user in the correct order by using an order parameter in each DLS message. The order parameter is the number in the square brackets, for example [1] or [2] etc, in this example, although other indicators could be used to indicate the order parameter, for example <1> or even one or more characters before a number, e.g. #1. Preferably lower numbers are displayed first in the list.

This means that DLS messages do not need to be received in order for the data to be processed correctly. It is important that the DLS messages can be processed correctly even though they were not received in the correct order. This is because currently, DLS messages have a maximum length of 128 characters and so information transmitted by the broadcaster has to be separated into messages of 128 characters or less.

The message is then stored or archived in memory 13 which is preferably a non-volatile memory for subsequent later retrieval by a database manager at step 21 under the appropriate category. Preferably the message is then displayed on the display 7. The message can be displayed unformatted, so that the tags and other formatting characters (see later) are viewed on the display. Alternatively the message displayed can be formatted by the database manager by using further formatting characters. This is described later in further detail with reference to the specific example of a tagged DLS string.

If, on the other hand, it is determined by the processor (comparator) at step 19 that there are no special identifiers, or that there is a start of tag identifier without a corresponding end of tag identifier, then the DLS parser determines at step 19 that the message is not a special DLS tagged message, and the message is preferably output to the display buffer, step 25 for display on the display 7. Alternatively, the message could be discarded without display on the display 7.

DLS tagged messages can be stored only without display and then subsequently viewed by a user. Alternatively, DLS tagged messages can be displayed as they are received in the same manner as normal DLS messages In this way, all received messages (either tagged or untagged) can output to the display buffer 7 at step 25.

Tagged messages can be retrieved from memory 13 under the control of the user interface 9. As the tagged messages have additional categorisation and formatting information, the user interface can present the information in additional ways to the original format of the text.

Therefore the five DLS messages of the previous example would be displayed and stored as follows:

```
Menu Root
  First Menu Item
  Second Menu Item
  Third Menu Item
  Fourth Menu Item
    Sub Menu
      First Menu Item
      Second Menu Item
      Third Menu Item
        Sub Menu
          First Menu Item
```

Categorising and storing messages in this way allows a user to later display a list of stored categories and select one of those categories so that the user can retrieve information that is of interest any time after a message containing that category of information has been received.

In a further embodiment the user can program the processor to selectively store DLS tagged messages that match user defined criteria. For example, a user may only be interested in storing messages that related to the DLS tag "Football" and "News". Then only messages with DLS tags matching or/and containing the text "Football" or/and "News" will be stored in the memory. Those skilled in the art will appreciate that this embodiment may be used on its own or in conjunction with any one or more embodiments herein described.

In a further embodiment, DLS messages can be stored for a predetermined period of time only. The user simply programs the device with the period of time for which they wish to keep the message. When the processor determines that a new DLS tagged message has been received, it also stores the date and optionally time when the message has been received and determines from the user defined storage period when the message should be deleted. This embodiment has the advantage that it avoids storing large numbers of DLS messages in the memory, which may be of less interest to the user because many of these messages are old and related to out of date messages. It also avoids the problem of the user having to manually delete messages when the memory unit 13 is full.

Furthermore, by restricting the number of DLS messages stored in the storage unit, it allows the user more easily to navigate through the messages when searching for information. This is because a smaller number of messages can be more easily displayed and searched on smaller displays which are common to receiver units.

Specific examples of tagged DLS messages are

DLS 1:

"*Football—Prem Lge Table[1]: 1. Chelsea 27 pts; 2. Spurs 18 pts; 3. Charlton 16 pts"

DLS 2:

"You're listening to Talksport with special studio guest Ledley King"

DLS 3:

"*Football—Prem Lge Table[3]: 7. Arsenal 12 pts; 8. Wigan 11 pts; 9. West Ham 10 pts"

DLS 4:

"*Football—Prem Lge Table[2]: 4. Man Utd 14 pts; 5. Man City 14 pts; 6. Bolton 14 pts"

This displays the following:

Football
Prem Lge Table
1. Chelsea 27 pts
2. Spurs 18 pts
3. Charlton 16 pts
4. Man Utd 14 pts
5. Man City 14 pts
6. Bolton 14 pts
7. Arsenal 12 pts
8. Wigan 11 pts
9. West Ham 10 pts Note, the DLS messages do not need to be received in order for the data to be processed correctly. DLS2 is not a special DLS, and this is displayed by the receiver but no data is categorised or stored.

In this embodiment it will be seen that the results of a number of matches are sent to a user via a number of tagged DLS messages. It is therefore possible that one of these messages may not be received by the receiver unit due to temporary poor reception, for example if the user is travelling through a tunnel when the message was broadcast. Preferably, therefore the system can include default text to display when one or more of the messages was not received. The text could simply be "#####" or any other suitable text. Preferably, the broadcaster will periodically repeat the set of tagged DLS messages throughout the day so that any missing messages displayed as "#####" can be displayed as the correct result.

In a further embodiment, the DLS tagged message can include information that can identify a particular edition of a DLS tagged message, that is to say when the particular DLS message was compiled by the broadcaster. In the previous example of Football results sent by tagged DLS messages, a broadcaster could send a number of tagged DLS messages throughout the day. The receiver unit can then be programmed either to ignore this edition information, for example the time and date of compliation and simply replace previous edition of DLS messages with newer editions. Alternatively, the receiver could be programmed to separately store different editions of messages so that the history of events throughout a particular period or day is recorded by the receiver for retrieval by a user later.

In this particular embodiment, the form of the DLS message could be:

DLS 1:

"*Football—Prem Lge Table@040106[1]: 1. Chelsea 27 pts; 2. Spurs 18 pts; 3. Charlton 16 pts"

This DLS message is interpreted by the receiver as having being complied on the 4$^{th}$ Jan. 2006, the "@" symbol indicating the edition of the DLS message. The receiver can then either overwrite results of the Premier League Table already stored in the storage device but compiled before the 4$^{th}$ January. Alternatively, the results of the Premier League Table could be separately stored for each day so that the user can retrieve the results relating to a particular day at a later date.

In a further embodiment, the information contained in the message comprises graphical information. In this embodiment, the graphical information is encoded in the broadcast message and can comprise all or part of the DLS tag and DLS message, that is the text between the SOT and EOT identifiers.

In a further embodiment, the parsing algorithm (and specifically the choice of SOT, EOT, and delimiter characters) or receiver firmware can be updated by the receiver receiving a specially tagged "update" message. This message can be received by all receivers but only receivers with the parsing algorithm can decode them. In one embodiment, the message is the format "*###UPDATE###: :*-; END". The asterisk "*" at the beginning and the colon ":" after the hash "#" are used as before to identify the DLS tag which is located there between. In the update message, the DLS tag is therefore "###UPDATE###" which is recognised by the processor as indicating that the text following the colon after the DLS tag is to be interpreted as new start of tag, end of tag and delimiting characters replacing the old SOT and EOT etc characters.

In this example the new SOT identifier is a ":" while the new EOT identifier is a "*", with the other characters unchanged. The order of the characters after the colon following the DLS tag determines how the processor should interpret a character.

In a further embodiment, the functionality of the radio receiver can be altered by sending a specifically tagged DLS message. An example of this could be with a dual-band DAB/FM capable radio receiver. The receiver is shipped to a user by default as DAB enabled only but is subsequently unlocked to operate as a dual-band DAB/FM receiver by a special DLS message sent to the receiver. The message includes the serial number of the product, so that the processor can compare the serial number of the device in question stored by the manufacturer in the memory 13 with the serial number sent in the enabling message. If it is determined that the two serial numbers match, then, the dual functionality of the receiver is enabled, whereas if the serial numbers do not match, then the dual functionality is not enabled. Alternatively, the sending of a special message without serial number could enable functionality on a batch of radios.

An example of an enabling DLS message is "*###ENABLE###: 12345-AXU555 END". In this message, the processor knows to interpret 12345-AXU555 as the serial number of the receiver, and "END" shows that it is the end of the update message.

The present invention is described with reference to a digital radio receiver, preferably a DAB radio receiver. Embodiments of the invention are also applicable to any receiver capable of receiving information, preferably text information, encoded with another signal for example an audio or visual signal. As well, those skilled in the art will appreciate the applicability of the invention to conventional analogue radio on the VHF/FM wavebands. For these wavebands additional information (e.g. text information) can be transmitted to a receiver. This is achieved by using an encoder to inject a Radio Data System (RDS) message on the normal FM radio signal modulated just above the stereo audio signal. To receive the RDS message during the broadcast, the microprocessor-controlled tuner is retuned to receive the RDS data, during which the audio signal is muted. This operation occurs within a few mS and so the user is unaware of any break in the broadcast.

For example the RDS system allows broadcasters to assign different programme types information (PTY) to their shows e.g. NEWS, ROCK MUSIC, or CLASSICS as well as other information to be encoded into the broadcast signal and detected by analogue receivers.

As in the previous embodiment such text would be displayed whether or not the messages are specifically tagged messages, but is only archived if the message is specially tagged with one or more alphanumeric characters such as a SOT and a corresponding EOT identifier. As before, this provides a useful way to archive and display information that may be useful to a user with an analogue radio equipped with RDS.

The invention claimed is:

1. A method for selectively storing dynamic label segment message information received with a digital audio broadcast signal, the method comprising the steps of:

(a) receiving a dynamic label segment message, the message comprising a plurality of characters;

(b) comparing each character of the received dynamic label segment message with a start of tag identifier stored in a memory;

(c) if one or more character(s) received in the received dynamic label segment message is determined to match the start of tag identifier stored in the memory then comparing each of the subsequent characters in the received dynamic label segment message with an end of tag identifier stored in the memory;

(d) determining if the received dynamic label segment message contains both the start of tag and the end of tag identifiers;

(e) identifying a dynamic label segment tag between the start of tag and the end of tag identifiers when the received dynamic label segment message contains both the start of tag and the end of tag identifiers; and (f) storing the dynamic label segment message in the memory for display when the dynamic label segment tag is identified.

2. The method according to claim 1 further comprising the steps of:

(a) determining a category of the dynamic label segment message by comparing one or more characters in the dynamic label segment tag to categories of dynamic label segment messages stored in the memory; and (b) if the one or more characters in the dynamic label segment tag is determined to match or contain one of the categories of the dynamic label segment messages stored in the memory, then storing the dynamic label segment message in the memory under the determined category.

3. The method according to claim 2, wherein if it is determined that no category stored in the memory matches one or more characters in the dynamic label segment tag, then storing the dynamic label segment message in the memory under a new category comprising one or more of the characters in the dynamic label segment tag.

4. The method according to claim 1 further comprising the step of displaying the information received in the message on a display.

5. The method according to claim 3, wherein if it is determined that the stored dynamic label segment message under the new category contains one or more characters matching one or more formatting characters stored in the memory, displaying the information received in the message in a format in dependence upon the matched formatting character(s).

6. The method according to claim 1 further comprising the steps of:

(a) comparing the character(s) in the dynamic label segment tag with an update identifier stored in the memory; and (b) if the character(s) in the dynamic label segment tag are determined to match the update identifier stored in the memory then updating one or more of the start of tag identifier, the end of tag identifier and formatting characters stored in the memory with those contained in the message.

7. The method according to claim 1, wherein the information comprises textual information.

8. The method according to claim 1, wherein the information comprises numerical information.

9. The method according to claim 1, wherein the information comprises graphical information.

10. The method according to claim 1, wherein the character(s) received in the dynamic label segment message comprise characters to update functionality of a receiver.

11. A Digital Audio Broadcast receiver comprising:

(a) a receiver for receiving a broadcast dynamic label segment message, the dynamic label segment message comprising a plurality of characters;

(b) a memory for storing the dynamic label segment message for display;

(c) a comparator for comparing each character of the received dynamic label segment message with a start of tag identifier stored in the memory;

(d) a comparator for comparing each of the subsequent characters in the received dynamic label segment message with an end of tag identifier stored in the memory if a character in the received dynamic label segment message is determined to match the start of tag identifier stored in the memory;

(e) means for determining if the received dynamic label segment message contains both the start of tag and the end of tag identifiers; and (f) means for identifying a dynamic label segment tag between the start of tag and the end of tag identifiers when the dynamic label segment message contains both the start of tag and the end of tag identifiers, wherein the memory stores the dynamic label segment message when the dynamic label segment tag is identified.

12. The digital audio broadcast receiver according to claim 11, wherein the receiver is a digital audio broadcast radio receiver.

13. The digital audio broadcast receiver according to claim 11, wherein the receiver is an analogue radio equipped with a radio data system.

* * * * *